US007870695B2

(12) United States Patent
Manson et al.

(10) Patent No.: US 7,870,695 B2
(45) Date of Patent: Jan. 18, 2011

(54) SUPPORT APPARATUS AND METHOD FOR ASSISTED TRAVERSAL OF A STRUCTURE

(76) Inventors: David Christopher Manson, 295 Quebec Avenue, Suite 2, Toronto, ON (CA) M6P 2V2; Christina Lynelle Manson, 295 Quebec Avenue, Suite 2, Toronto, ON (CA) M6P 2V2; Sylvan Sherwood Browne, 295 Quebec Avenue, Suite 2, Toronto, ON (CA) M6P 2V2

( * ) Notice: Subject to any disclaimer, the term of this patent is extended or adjusted under 35 U.S.C. 154(b) by 539 days.

(21) Appl. No.: 11/490,137

(22) Filed: Jul. 21, 2006

(65) Prior Publication Data

US 2007/0017170 A1 Jan. 25, 2007

Related U.S. Application Data

(60) Provisional application No. 60/701,482, filed on Jul. 22, 2005.

(51) Int. Cl.
*E04F 11/00* (2006.01)

(52) U.S. Cl. ..... 52/184; 52/27; 52/174; 198/335

(58) Field of Classification Search ..... 52/184, 52/27, 174; 182/106, 230; 5/658, 662, 81.1 R; 198/335; 187/201, 200, 202
See application file for complete search history.

(56) References Cited

U.S. PATENT DOCUMENTS

| | | | | |
|---|---|---|---|---|
| 2,708,473 A | | 5/1955 | Gable et al. | |
| 3,176,700 A | | 4/1965 | Drury, Jr. | |
| 3,387,618 A | | 6/1968 | Swann | |
| 3,421,529 A | | 1/1969 | Vestal | |
| 3,455,313 A | | 7/1969 | King | |
| 4,094,331 A | | 6/1978 | Rozsa | |
| 4,253,287 A | * | 3/1981 | Overmoe | 52/184 |
| 4,411,283 A | | 10/1983 | Lucarelli | |
| 4,899,989 A | * | 2/1990 | Kitson et al. | 256/1 |
| 4,995,412 A | | 2/1991 | Hirn et al. | |
| 5,022,197 A | * | 6/1991 | Aragona | 52/29 |
| 5,269,227 A | * | 12/1993 | Warren et al. | 105/29.1 |
| 5,349,977 A | | 9/1994 | Wood | |
| 5,363,771 A | * | 11/1994 | Warren et al. | 105/29.1 |
| 5,603,517 A | | 2/1997 | Lorman | |
| 5,636,651 A | | 6/1997 | Einbinder | |
| 5,649,558 A | | 7/1997 | Richards | |
| 5,740,825 A | | 4/1998 | Brunengo | |
| 6,453,921 B1 | | 9/2002 | Rost | |
| 7,395,764 B2 | * | 7/2008 | Debrunner | 104/89 |
| 2006/0243112 A1 | * | 11/2006 | Debrunner | 83/455 |

* cited by examiner

*Primary Examiner*—Brian E Glessner
*Assistant Examiner*—Joshua Ihezie
(74) *Attorney, Agent, or Firm*—Sylvan S. Browne

(57) ABSTRACT

Embodiments of the invention relate to an apparatus for assisted walking on stairs or other sloped surfaces. The apparatus may also be used for assisted walking on slippery surfaces. The apparatus comprises a fixed support and a moveable support. The fixed support is fixed relative to the stairs or other walking surface, while the movable support is selectively moveable relative to the stairs and fixed support in a direction substantially parallel to an incline of the stairs. The movable support is selectively positionable relative to the fixed support in one of a plurality of closely spaced discrete locking positions in which the movable support can support a personal relative to the stairs.

15 Claims, 13 Drawing Sheets

SUPPORT APPARATUS AND METHOD FOR ASSISTED TRAVERSAL OF A STRUCTURE

RELATED APPLICATIONS

This application claims the benefit of U.S. Provisional Application Ser. No. 60/701,482 filed on Jul. 22, 2005, the entire contents of which are hereby incorporated by reference.

TECHNICAL FIELD

The present invention relates to a support apparatus and method for assisted traversal of a structure. More particularly, the present invention relates to an apparatus for assisted walking on sloped structures, slippery surfaces, or other structures that may be traversed more easily with support.

BACKGROUND

Many people, including elderly and disabled people, have difficulty in ascending and descending stairs or another sloped or slippery surface or structure. This can be for a variety of reasons, but is commonly due to being unable to safely or comfortably support their own weight on their legs. Accidents can easily occur for such people in such circumstances and therefore it is desirable to provide some form of stability or weight support, such as an upper body support, to assist persons while they traverse the sloped surface or structure.

U.S. Pat. No. 6,453,921 to Rost describes a free-standing four legged structure which can be used for supporting a person while climbing stairs. The structure has two front legs and two back legs, with the front and back legs being adjustable in length so that, when the support structure is placed on stairs, one set of legs rests on an upper step and the other set of legs rests on a lower step. In this way, the structure accommodates the difference in height between the stairs, while remaining upright to support the person during his or her ascent.

Four legged "walker" structures, such as that described by Rost can be awkward and do not provide the user with a fixed support, even when properly engaged. If the user mis-steps or does not engage the walker properly, the user may fall, which will likely result in injury or at least pain and inconvenience. Also, the user must physically lift the walker from step to step in advance of each ascending or descending step. Even if the walker structure is particularly light-weight, this may be difficult or awkward for infirm or disabled persons and may contribute to, or fail to prevent, a loss of balance.

U.S. Pat. No. 4,899,989 to Kitson et al describes a length of rail secured directly to a wall parallel to the stairs and a rubber handle which is slidable along the rail. The handle is slidable along the rail if force is applied to the handle in a direction parallel to the longitudinal extent of the rail but becomes frictionally jammed with respect to the rail if force is applied in any other direction. The Kitson et al apparatus provides only a small flexible rubber handle, inadequate to support a person's weight if he or she began to lose balance or needed to rest. Also, because the Kitson et al device is secured directly to the wall, it cannot also act as a hand rail for others climbing the stairs.

SUMMARY

Certain embodiments relate to an apparatus for assisted walking on stairs. The apparatus comprises a fixed support, which in use of the apparatus is fixed relative to the stairs. The apparatus also comprises a movable support, which in use of the apparatus is selectively movable relative to the stairs and the fixed support in a direction substantially parallel to an incline of the stairs. The movable support is selectively positionable relative to the fixed support in one of a plurality of closely spaced discrete locking positions in which the movable support can support a person relative to the stairs.

The fixed support may be fixed to a wall or a fixed railing, for example. The fixed support is rigidly fixed relative to the stairs so as to be able to bear the weight of a person while climbing the stairs.

A first portion of the movable support may be at least partly received in the fixed support. The fixed support may be formed as a substantially elongated rail, similar to a normal handrail and has a central border through for receiving the first portion of the movable support therein. The fixed support is preferably tubular and of a generally rounded cross section. A second portion of the movable support may extend away from the fixed support. The second portion may extend substantially perpendicularly away from the fixed support. The first portion of the visible support may be disposed at one end of the movable support and is fixed against movement other then a limited degree of rotation and along the direction of the stairs and the second portion includes an oppositely disposed free end.

The movable support is securable against movement relative to the fixed support by a locking mechanism. The fixed support may include an elongate slot having discrete locking positions at which the movable support is securable against movement relative to the fixed support. The elongate slot comprises a plurality of recesses for receiving an engaging part of the moveable support, where each recess corresponds to a respective discrete locking position. In one embodiment, the movable support includes a grip extending therefrom and the elongate slot includes a plurality of notches for receiving at least a part of the movable support therein.

The movable support may comprise a gripping means disposed away from the fixed support. The gripping means may include a bar. The gripping means may be disposed on or adjacent the bar. The bar may be substantially straight or it may have a curved portion. The bar may extend substantially laterally of the fixed support and at least one of the gripping means comprises a protruding portion.

The movable support may include a slideably movable support relative to the fixed support. The movable support may comprise a bar having a fixed end fixed at one end thereof to the slider and an oppositely disposed free end. The movable support may be pivotably movable relative to the fixed support about a longitudinal axis of the fixed support. Pivotal movement of the movable support relative to the fixed support may be limited to between 0 and about 45 degrees at locking positions located between opposite ends of the fixed support. At opposite ends of the fixed support, pivotal movement is limited to between 0 and about 125 degrees. The pivotal movement allowable at each opposite end is such that the moveable support can be stowed in a rest position angularly displaced relative to the locking positions.

Other embodiments relate to an apparatus for assisted walking on a sloped or slippery surface or structure. The apparatus comprises a fixed support, which in use of the apparatus is fixed relative to the surface or structure. The apparatus also comprises a movable support, which in use of the apparatus is selectively movable relative to the surface or structure and the fixed support in a direction substantially parallel to an incline of the surface or structure. For a slippery surface or structure, such as an icy path or a slippery bridge, the incline may be zero. The moveable support is adapted to support a person traversing the surface.

The movable support is selectively positionable relative to the fixed support in one of a plurality of closely spaced discrete locking positions in which the movable support can support a person relative to the surface or structure. The fixed support is preferably fixed to a rigid support structure such as a wall or railing adjacent the surface or structure. Embodiments of this aspect comprise similar features or variations to those described in relation to the first embodiments described above.

Embodiments of the invention provide a sturdy support structure for assisting people to traverse stairs or slippery surfaces. The movable support can be used by a person to support his or her weight while they move their feet up or down the stairs or along the surface. Once the person has stable footing, he or she may move the movable support from one locking position to another locking position in the direction of desired movement and may then step forward again to progress along the stairs or surface. Providing a movable support that extends laterally away from the longitudinal fixed support allows a person traversing the stairs or the surface to support himself or herself by pulling or leaning generally downwardly, on the movable support when in a locking position. In one embodiment, in its locking position, the movable support can be moved to another locking position by upward movement of the bar of the movable support followed by longitudinal movement in the direction of inclination of the stairs or surface until another of the locking positions is selected and the bar is rotated downwardly to engage the movable support in the selected locking positions.

Yet other embodiments relate to an assisted walking apparatus comprising a fixed support, a movable support, a brake, and an actuator coupled to the brake. The fixed support is fixed relative to a surface or a structure while the movable support is slidably and selectively movable relative to the surface or structure and the fixed support in a direction substantially parallel to an incline of the surface or structure. The brake, when actuated, operates to retard sliding movement of the movable support relative to the fixed support and the actuator is operable by a user gripping at least a portion of the movable support while being supported by the movable support.

Yet other embodiments relate to apparatus for assisted traversal of an inclined structure. The apparatus comprises a fixed support fixed relative to the inclined structure and a movable support. The movable support is slidably movable relative to the fixed support along a longitudinal axis of the movable support, the movable support having a locking portion cooperating with the fixed support for releasably fixing the movable support against movement along the longitudinal axis and having a sliding portion and a support portion. The support portion extends away from the sliding portion for supporting a person during traversal of the inclined structure. The longitudinal axis is substantially parallel to an incline of the inclined structure and the support portion has a first portion extending away from the sliding portion along a first lateral axis and a second portion extending away from the sliding portion along a second lateral axis offset from the first axis.

Other embodiments relate to an apparatus for assisted traversal of a structure, the apparatus comprising:

a fixed support, in use of the apparatus, fixed relative to the structure;

a movable support, in use of the apparatus, selectively slidably movable relative to the structure and the fixed support in a direction substantially parallel to an incline of the structure, the movable support having a support arm extending away from the fixed support;

a brake for selectively causing frictional braking engagement of at least a first portion of the movable support with at least a second portion of the fixed support and thereby retard movement of the movable support relative to the fixed support; and an actuator means disposed on the support arm and coupled to the brake for actuating the brake.

Other embodiments relate to methods of use and of installation of the apparatus aspects described above. Still other aspects relate to methods of manufacturing the apparatus aspects described above.

The described embodiments allow a person to safely and securely ascend or descend a staircase or other challenging structure by providing a rigid support bar in a convenient front-on position for the person to hold on to while traversing the stairs.

BRIEF DESCRIPTION OF THE DRAWINGS

Embodiments of the invention are hereinafter described in further detail, by way of example only, with reference to the accompanying drawings, in which.

DETAILED DESCRIPTION

Figure 1:
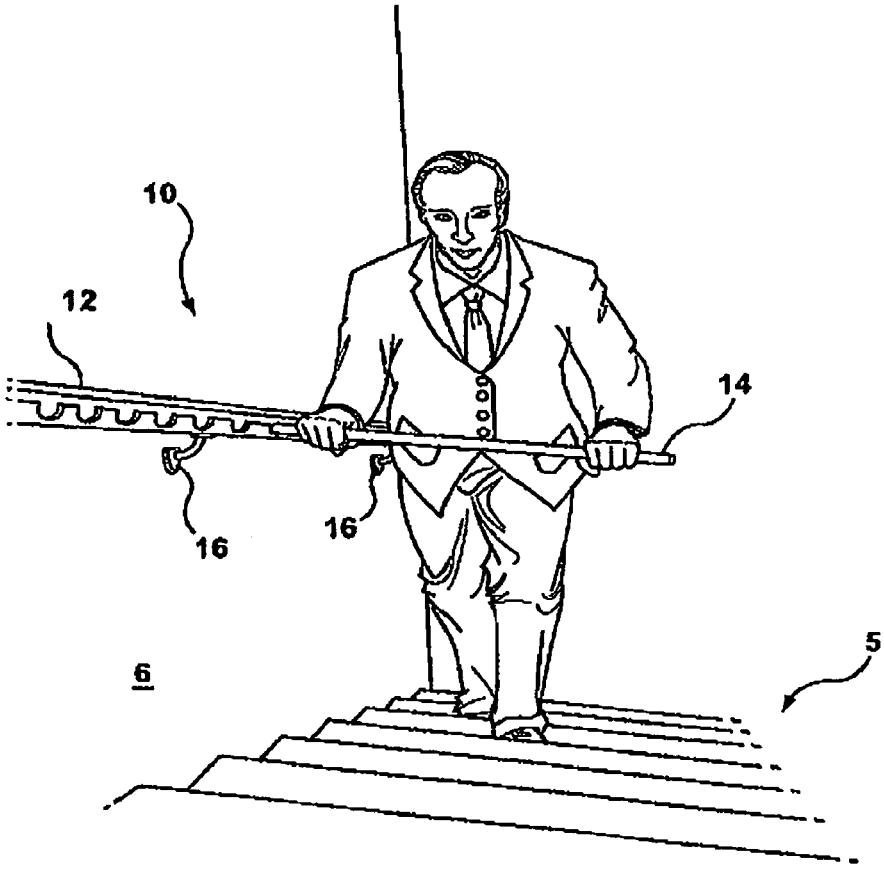
FIG. 1 is a perspective view of an assisted walking apparatus, in use, according to an embodiment of the invention.
Figure 2:
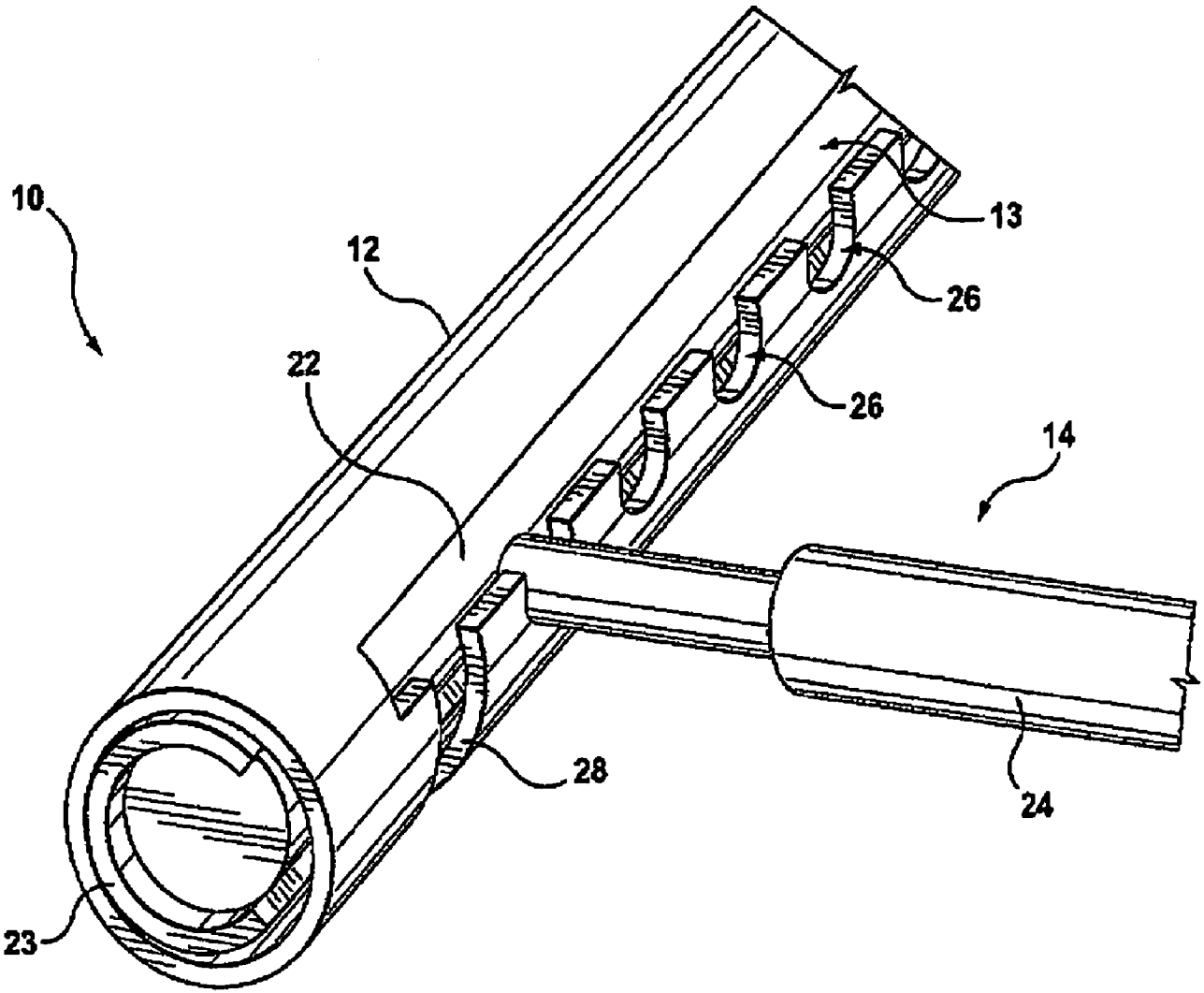
FIG. 2 is a partial isometric view of the assisted walking apparatus of FIG. 1.

Embodiments generally relate to support apparatus for assisting a person to traverse a sloped or slippery structure. Related embodiments include methods of use, installation and manufacture of the apparatus.

Several embodiments of the support apparatus are shown and described in relation to the drawings. Each embodiment employs the same basic structure, which includes a movable support having a bar that can extend laterally and can be fixed in position relative to the stairs or other inclined structure, yet is also slideable relative to a fixed support structure, such as a railing, so that the lateral support bar can be repositioned into appropriate support positions as the person traverses the stairs.

Use of a bar or other similar form of support member extending laterally away from the handrail and generally parallel to the surface of the stairs allows the person to position the lateral support bar in front of the person while traversing the stairs. This front-on positioning of the lateral support bar means that the person does not have to twist toward the handrail if using two hands for support while traversing the stairs. This sideways twisting necessitated by conventional railings when using two hands for support may lead to instability or over-balancing, which may lead to injury.

A first embodiment of the support apparatus is shown and described in relation to FIGS. 1 to 5. The support apparatus is designated generally by reference numeral 10. Support apparatus 10 includes a generally elongate fixed support 12, which may be in the form of a hollow railing fixed to a wall 6 by wall mounting brackets 16. The support apparatus also includes a movable support 14, which comprises a sliding portion 22 and a support bar 24.

In use of the support apparatus 10, a person may slide the movable support 14 along the fixed support 12 in a direction parallel to an incline of the stairs 5 on which the person stands or walks. The sliding portion 22 is captured within and slides along a hollow bore (not shown) of the fixed support 12. Support bar 24 is connected to the sliding portion 22 and extends laterally away from the sliding portion 22 when it is being used to support a person traversing the stairs 5.

Fixed support 12 has a slot 13 extending substantially the whole length of the fixed support 12. Slot 13 permits the support bar 24 to extend therethrough and connect with the sliding portion 22, which is captured within the longitudinally extending bore of the fixed support 12. Fixed support 12 has a number of recesses 26 extending downwardly from slot 13 for receiving a portion of the support bar 24 adjacent where it connects to sliding portion 22.

When the support bar 24 is received in a recess 26, the movable support 14 is fixed against downward movement and longitudinal (sliding) movement. In this way, the movable support 14 may be fixed in a number of discrete locking positions corresponding to the plurality of recesses 26, in which a person using the support apparatus 10 may use the support bar 24 to support his or her weight. When the person desires to reposition the moveable support 14 in order to reach the next step, he or she lifts the support bar 24 upward, rotating the sliding portion 22 about its longitudinal axis (which it shares with fixed support 12) so that the support bar 24 is no longer held in a recess 26 but is free to slide along slot 13. Recesses 26 are relatively numerous and closely spaced along slot 13, so that the person traversing the stairs has a number of positions to chose from when selecting where to position the moveable support 14 for best supporting the person's weight.

Support bar 24 is a light but strong bar or pole having one or more grips 25 located along the bar for gripping by a person during use of the support apparatus 10. The support bar 24 must be of sufficient strength and rigidity to adequately support most or all of a person's weight, if necessary, up to a few hundred pounds or kilograms. Similarly, fixed support 12, which must counteract the moment applied to the support bar 24 by the person during use, must be suitably secured to an adjacent structure, such as wall 6, in a manner adequate to support a few hundred pounds or kilograms. Accordingly, mounting brackets 16 are of a sturdy, heavy-duty quality and are bolted to the wall.

In order to reduce the degree to which moveable support 14 is required to rotate when shifting positions, a sleeve 23 may be used within fixed support 12 so that the sliding portion 22 slides within sleeve 23. Sleeve 23 has a slot extending longitudinally, corresponding to slot 13, but wider so as not to occlude recesses 26. If sleeve 23 is used, sliding portion 22 may have a somewhat reduced cylindrical diameter.

At each longitudinal end of support apparatus 10, fixed support 12 has a single radial slot 28 extending downwardly from longitudinal slot 13. The radial slots 28 are sized to allow the support bar 24 to be received therein and extend radially to an underside of fixed support 12. This allows support bar 24 to be stowed in a position pending downwardly from fixed support 12, as shown in FIGS. 4 and 5, so that the support bar 24 does not obscure passage of the stairs when not in use.

Figure 3:
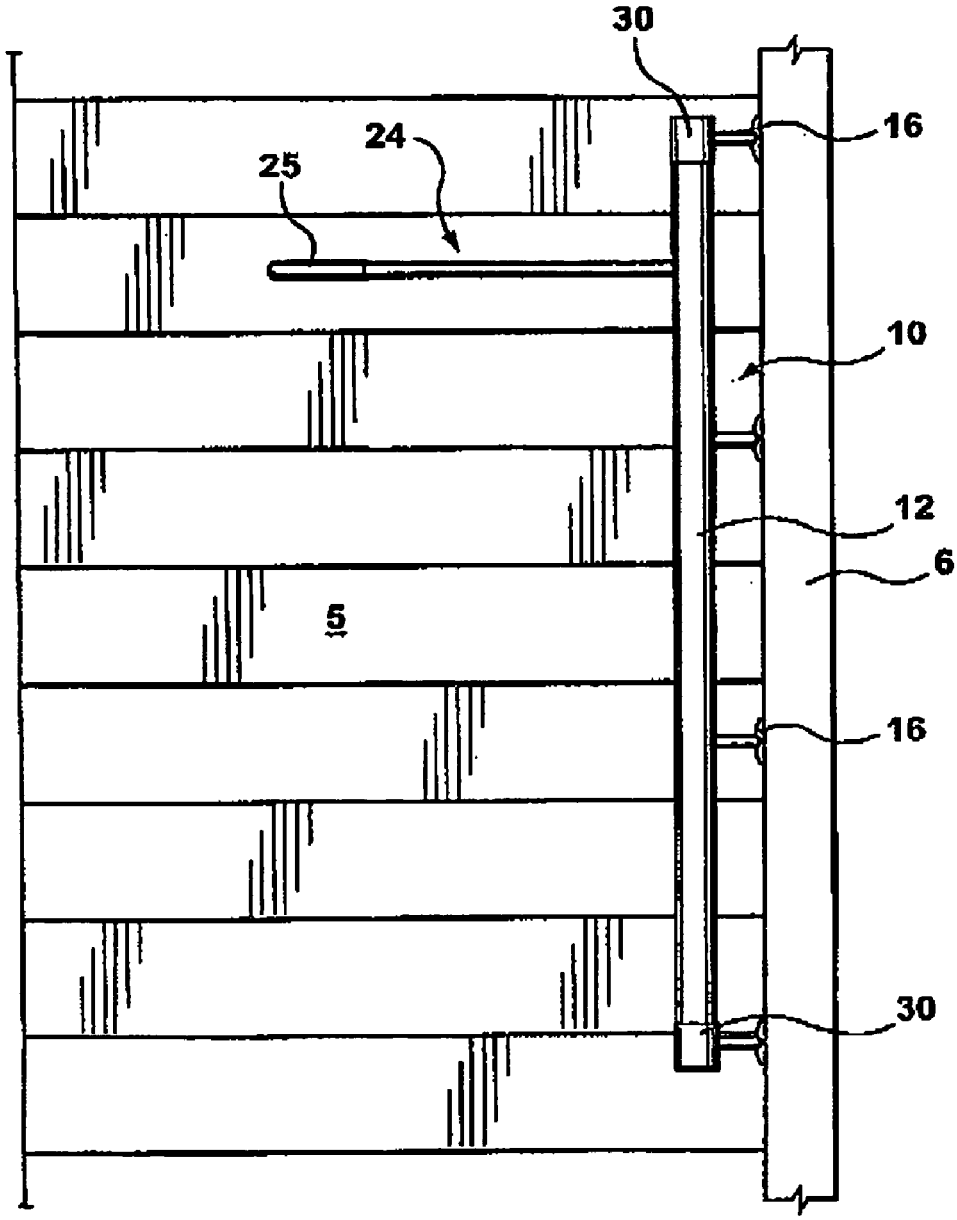
FIG. 3 is a front view of an assisted walking apparatus according to one embodiment of the invention located in fixed relation to stairs.
Figure 4:
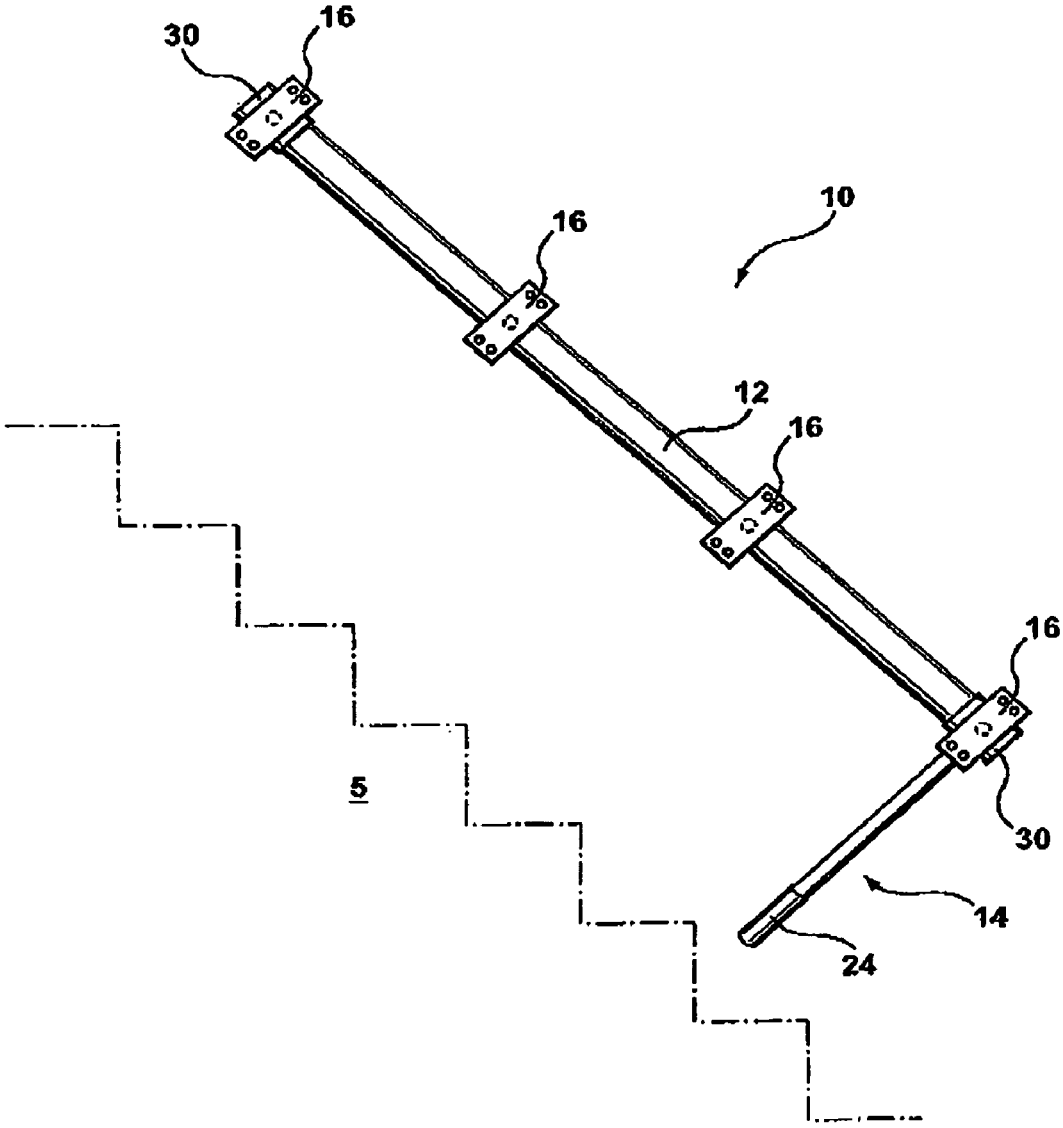
FIG. 4 is a side view of the embodiment shown in FIG. 3.
Figure 5:
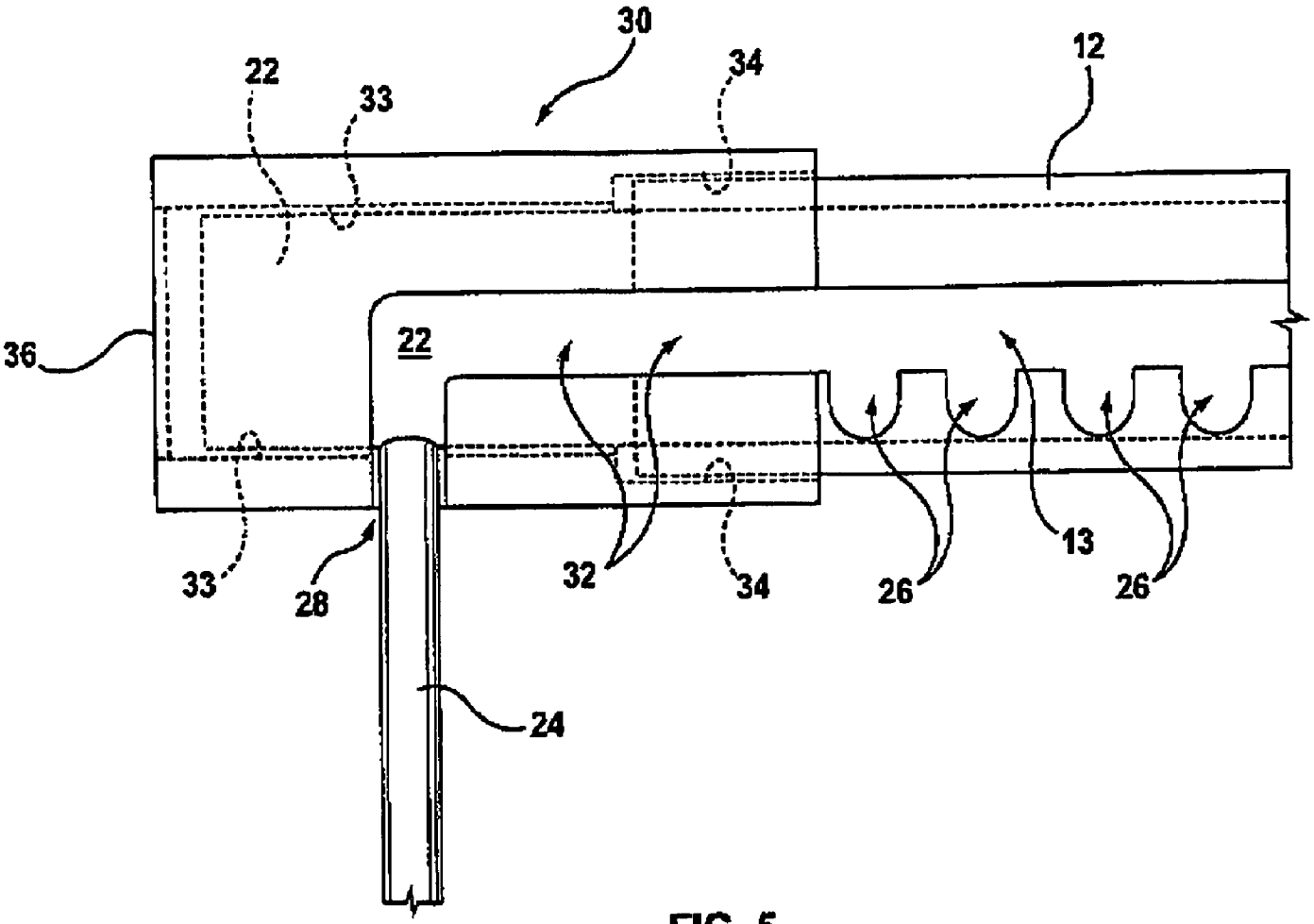
FIG. 5 is a close up side view of an end portion of the assisted walking apparatus.

As shown in FIGS. 3, 4 and 5, support apparatus 10 may further include an end cap 30 fitted onto each longitudinal end of the fixed support 12. The end cap 30 may provide radial slot 28 for stowing the support bar 24, instead of having radial slot 28 formed directly in fixed support 12.

End cap 30 has an open end for receiving the end of fixed support 12 therein and a closed end 36 opposite the open end. End cap 30 has a bore of substantially the same diameter as that of fixed support 12 so that it can receive movable support 14 when it is positioned at the end of support apparatus 10. End cap 30 has a longitudinal slot 32 extending from the open end towards the closed end 36 and radial slot 28 extending downwardly from slot 32 from receiving the support bar 24 in its stowed position.

End cap 30 has a larger diameter portion 34 toward its open end for fitting over the end of fixed support 12 and a smaller diameter portion 33 having a diameter substantially the same as the bore diameter of fixed support 12 so that sliding portion 22 can slide easily between end cap 30 and fixed support 12.

Using end cap 30 to provide radial slots 28 at either end of fixed support 12 enables fixed support 12 to be formed as a long tubular member which can be cut to a desired length, depending on the length and height of the stairs adjacent which to the support apparatus 10 is to be installed. Thus, radial slots 28 do not need to be machined in advance, as they can be provided by end caps 30 which can installed on site once the desired length of fixed support 12 is determined.

While support bar 24 is shown in FIGS. 1-5 as being a straight bar of substantially uniform diameter, it should be understood that other forms of support bar may be employed, for example such as those shown in FIGS. 11*a* to 11*d* or FIGS. 12 to 16. Other forms of support bar may include portions axially displaced from each other and may include gripping protrusions extending out of and away from the support bar or other structures for assisting a person to grip the support bar 24, support the person's weight or manipulate the support bar during operation of support apparatus 10. Further, support bar 24 need not be of a constant diameter. Support bar 24 and sliding portion 22 may be removably connected to each other, for example by screw-threaded engagement, for ease of assembly.

Figure 6:
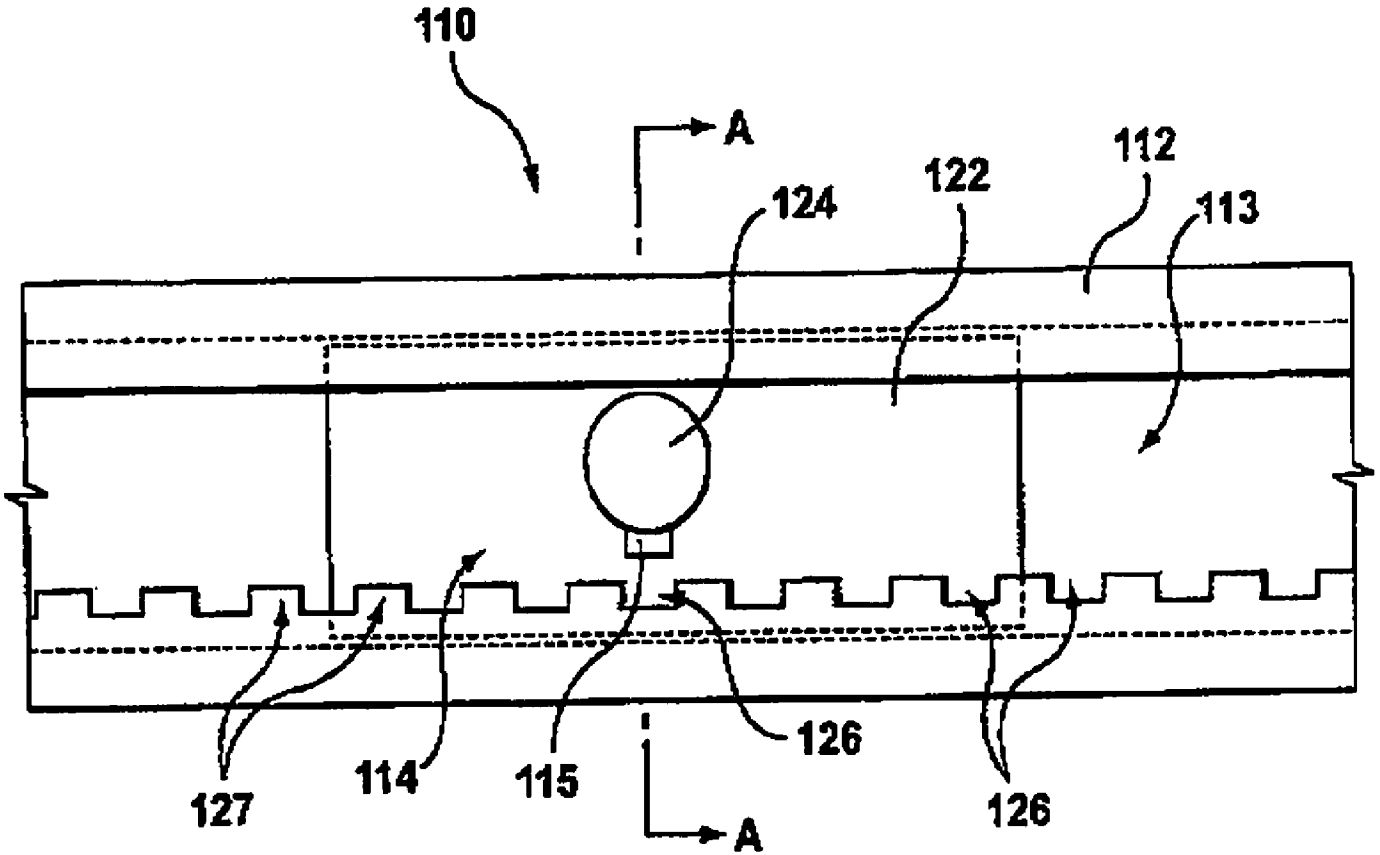
FIG. 6 is a partial side view of an assisted walking apparatus according to another embodiment.
Figure 7:
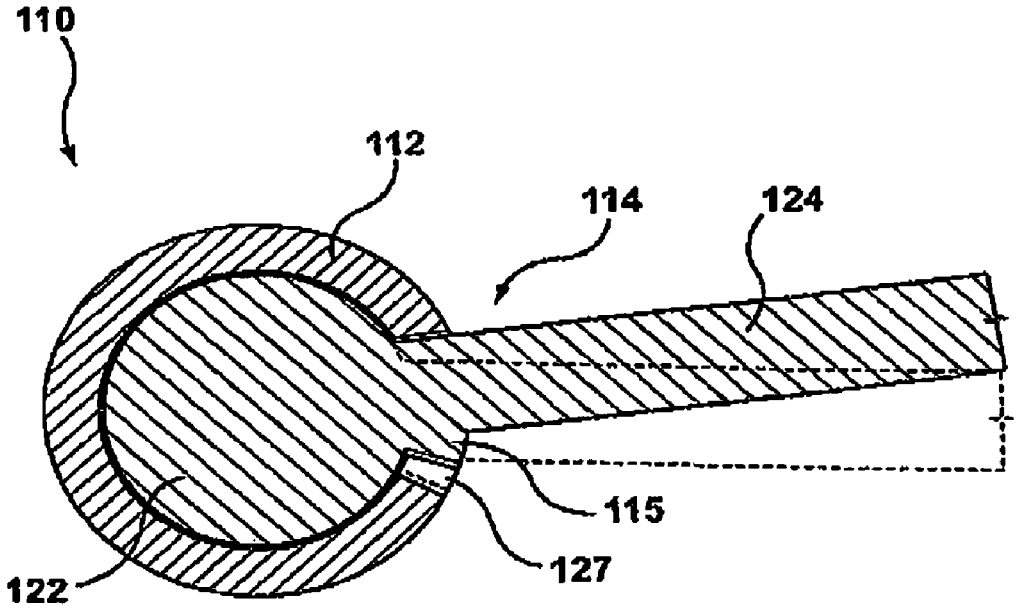
FIG. 7 is a cross sectional view of the embodiment of FIG. 6, taken along line A-A.

Referring now to FIGS. 6 and 7, there is shown an alternative embodiment of the support apparatus, designated by reference 110. Support apparatus 110 operates in a similar manner to support apparatus 10, except that it uses a modified structure for locking the moveable support in position. As shown in FIG. 6, a moveable support 114 slides along a longitudinal bore of fixed support 112, while a support bar 124 of the moveable support 114 extends laterally outwardly through a slot 113 running longitudinally along fixed support 112. This is structurally similar to support apparatus 10. Support apparatus 110 differs, however, in that smaller and more closely spaced slots 126 extend downwardly from slot 113 and support bar 124 has a protrusion 115 extending downwardly from its base, adjacent where support bar 124 connects with sliding portion 122. Protrusion 115 is sized to fit into one of the recesses 126 so as to lock moveable support 114 against longitudinal movement relative to the fixed support 112. Each recess 126 is defined by adjacent projections 127 which bracket protrusion 115 when is it received in a recess 126.

Thus, moveable support 114 may be positioned in one of many Discrete locking positions along fixed support 112 by rotating the moveable support 114 angularly downwards so that protrusion 115 is received within a recess 126. To reposition moveable support 114, the person using support apparatus 110 need only lift support bar 124 slightly so as to withdraw protrusion 115 from recess 126, slide moveable support 114 along fixed support 112 to a desired position and replace protrusion 115 in a recess 126 at that position.

FIG. 7 shows support apparatus 110 in an end cross-sectional view, where moveable support 114 is shown in a slidable position in solid lines and in a locked position (in which moveable support 114 is fixed against longitudinal sliding)—in dashed lines.

Figures 8, 9:
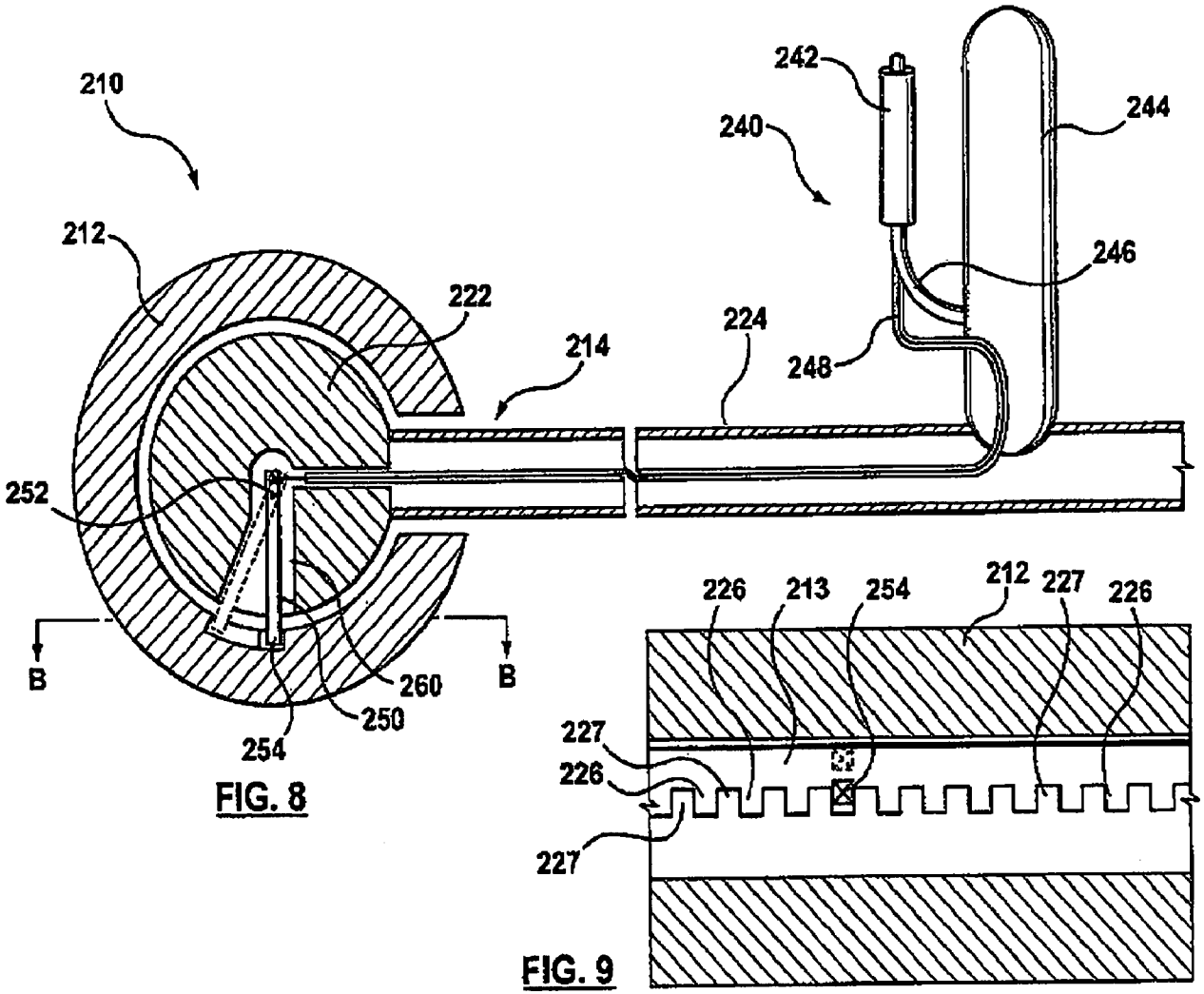
FIG. 8 is a partial cross sectional view of an assisted walking apparatus according to yet another embodiment of the invention.
FIG. 9 is a cross section of the embodiment shown in FIG. 8, taken along line B-B.

A further embodiment is described in relation to FIGS. 8 and 9 and designated by reference 210. Support apparatus 210 is shown in FIG. 8 in partial cross-sectional end view. Support apparatus 210 is similar to the support apparatus 10 and 110, in that it uses a moveable support to 214 slidable within a fixed support 212 and fixable against longitudinal movement in one of a plurality of discrete locking positions. However, instead of rotating the support bar 24 to move the moveable support 14 or 114 between locked and unlocked positions, the moveable support 214 does not need to rotate upwardly or downwardly between locked and unlocked positions. Rather, support apparatus 210 uses actuation means 240, such as a lever actuator 242 connected to a cable 248, to move a locking member 250 connected to sliding portion 222 between locked and unlocked positions relative to fixed portion 212.

In the embodiment illustrated in FIG. 8, lever 242 pivots about a pivot 246 so that, when lever 242 is depressed, it pulls on cable 248, to which it is connected. Cable 248 is connected at one end to lever 242 and to locking member 250 at its other end. Locking member 250 is pivotally connected to sliding portion 222 at pivot point 252. Pivot point 252 is located intermediate the point where cable 248 connects to locking member 250 and an opposite engaging end 254 of locking member 250, which engages recesses 226 in between projections 227 along a slot 213 of fixed support 212.

When cable 248 is pulled by actuation of lever 242, cable 248 in turn pulls on locking member 250 in the direction of support bar 224 and away from fixed support 212. This causes locking member 250 to pivot about pivot point 252 so that engagement portion 254 of locking member 250 moves out of a locking position, in which it is received within one of the recesses 226, to an unlocked position, in which engaging portion 254 may slide freely along slot 213 (as moveable support 214 slides within fixed support 212).

Biasing means 260, such as a spring or other resiliently deformable member, serves to bias locking member 250 to the locking position in which engaging portion 254 is received within a recess 226, thereby preventing longitudinal movement of moveable support 214 within fixed support 212. When actuation means 240 is actuated, locking member 250 is moved away from the locking position against the action of biasing means 260 and, when actuation means 240 is released, biasing means 260 tends to return locking member 250 to the locked position. Thus, moveable support 214 can only be moved longitudinally along fixed support 212 by actuation of actuation means 240. Upon release of actuation means 240 and engaging portion 254 of locking member 250 being received within a recess 226, moveable support 214 again becomes fixed relative to fixed support 212.

Locking member 250 is preferably moveable into and out of recesses 226 as indicated in FIGS. 8 and 9 in response to actuation of actuation means 240 by relative angular displacement of engaging portion 254 within slot 213. Alternatively, other configurations may be applied to similar effect. For example, locking member 250 may be configured to move between a locking position, in which engaging portion 254 extends into a recess in the interior wall of fixed support 212, and an unlocked position, in which locking member 250 is retracted into sliding portion 222 so that engaging portion 254 does not engage a recess in fixed portion 212.

It will be understood that other forms of mechanical interaction between the components of support apparatus 210 may be employed in order to achieve the functions described herein. Importantly, such functions include actuation means which cause a locking member to move between a locked position and an unlocked position without requiring rotational movement of the moveable support 214 relative to the fixed support 212. In particular, while actuation means 240 is shown as a lever 242 connected to a cable 248, with the lever 242 being positioned on a handle 244, other forms of actuation means may be employed, such as those involving pressing a button, rotating a sleeve or otherwise using a mechanical member to exert a pulling or pushing force to be translated into action on the locking member 250 and cause it to change position.

Figure 10:
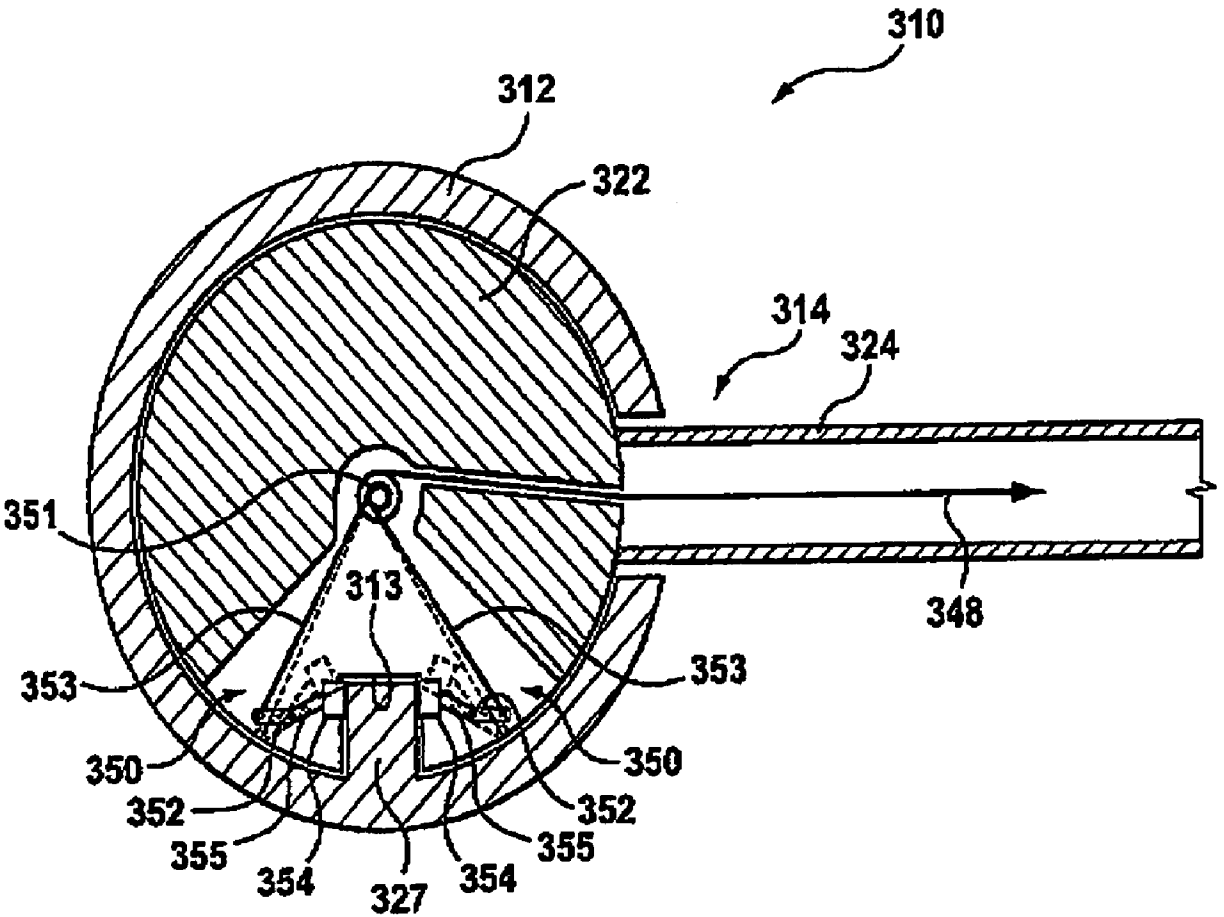
FIG. 10 is a partial cross sectional view of an assisted walking apparatus according to another embodiment of the invention.

Referring now to FIG. 10, a further embodiment of the support apparatus is shown in partial cross-section and designated by reference numeral 310. Support apparatus 310 is similar to support apparatus 210, in that it uses actuation means (not shown) accessible on support arm 324 for causing movable support 314 to be fixed against slidable movement relative to fixed support 312. Similarly, support apparatus 310 does not employ rotation of movable support 314 relative to fixed support 312 in order to slide moveable support 314 between fixed positions. However, instead of employing recesses in discrete spaced locations, support apparatus 310 uses frictional engagement between sliding portion 322 and fixed support 312 in order to prevent longitudinal movement of movable support 314. Such frictional engagement is preferably provided by braking means 350, for example in the form of brake pads, engagable with a part of fixed support 312. The braking means 350 is actuated by actuation means of a similar nature to that described in relation to FIG. 8, which is configured to pull on a cable 348, which in turn causes the braking means 350 to grip a protrusion 327 on fixed support 312.

Brake means 350 preferably functions in a manner similar to cantilever brakes for bicycles. Brake means 350 thus may include at least one, but preferably two, brake pads 354 which, when the brake means 350 is not actuated by the actuation means, do not contact (or only minimally contact) protrusion 327. Brake means 350 include brake levers having at one end the brake pads 354 and, at an opposite end, a cable connection point, at which cables 353 (connected to cable 348) are connected. The brake levers are connected to sliding portion 322 at pivot connections 352 intermediate the brake pads 354 and the cable connection points. Biasing means (not shown) coupled to the brake pads 354 or brake levers are also provided to bias the brake levers to a position in which they do not engage protrusion 327. Such biasing means may include a spring or other form of resilient biasing member.

In order to fix movable support 314 relative to fixed support 312, the actuation means is actuated, pulling on cable 348. Cable 348 passes over a spindle 351 attached to sliding portion 322 and connects to a branching member (not shown) or other form of connector for transferring the pulling force to cables 353. When pulled by cable 348, cables 353 are pulled toward spindle 351, causing brake levers 355 to pivot about pivot points 352 so that brake pads 354 frictionally engage protrusion 327, thus retarding or stopping movement of moveable support 314 relative to fixed support 312.

Protrusion 327 extends along the full length of fixed support 312 (except at the ends, where structure similar to end cap 30 may be provided for allowing the support bar 324 to be stowed in a downward position). Sliding portion 322 has a recess 313 formed therein of a complimentary shape to protrusion 327.

It should be understood that the structure illustrated in FIG. 10 for providing the described braking function is exemplary only and that modifications or enhancement may be made without departing from the spirit and scope of this aspect of the invention. Specifically, other structures may be employed for causing one or more portions attached to sliding portion 322 to frictionally engage one or more portions or surfaces of fixed support 312.

Referring now to FIGS. 11A to 11D, different embodiments of the moveable support are shown. Each of the embodiments shown in FIGS. 11A to 11D are exemplary only and it should be understood that different functions and/or elements of the described or depicted embodiments may be combined with one or more of the functions and/or elements described in relation to any of the other embodiments of movable supports described herein.

Figure 11A:
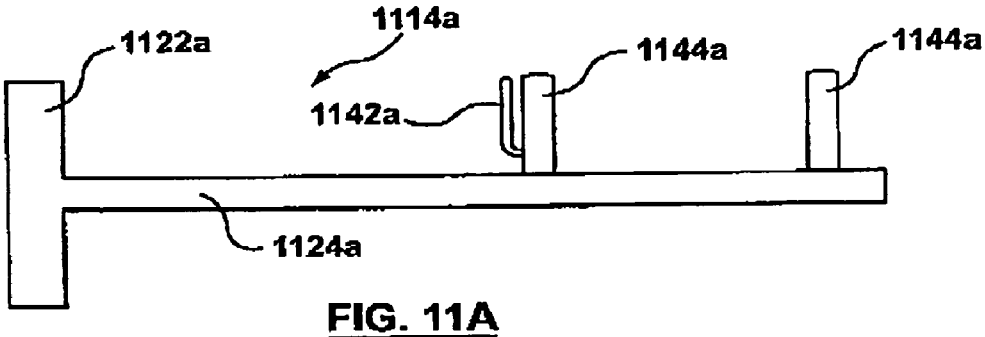
FIGS. 11A to 11D are plan views of alternative movable support structures for use with embodiments of the invention.

FIG. 11A shows a movable support 1114*a* having a sliding portion 1122*a* connected to a support bar 1124*a*. The support bar 1124*a* has handles 1144*a* projecting away therefrom at spaced locations away from sliding portion 1122*a*. At least one of the handles 1144*a* may have a lever 1142*a* connected thereto and forming part of an actuation means, such as actuation means 240 or that described (but not shown) in relation to FIG. 10. The precise length of the support bar in each embodiment described herein is unimportant, except insofar as it relates to the function of the support bar to support a person while traversing the stairs. Exemplary lengths of the support bar may be between about 2 feet to 4 feet long.

Figure 11B:
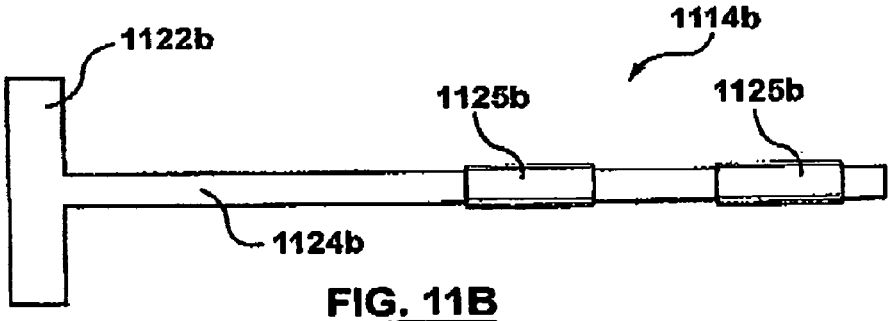

FIG. 11B shows a movable support 1114*b* having a sliding portion 1122*b* connected to a support bar 1124*b*. The support bar 1124*b* has two grips 1125*b* spaced along its length. Grips 1125*b* are formed of a suitable rubber or foam, for example, adhered to support bar 1124*b*. In an alternative form, movable support 1114*b* may have a single long grip extending substantially the length of support bar 1124*b*, rather than at separate spaced locations.

Figure 11C:
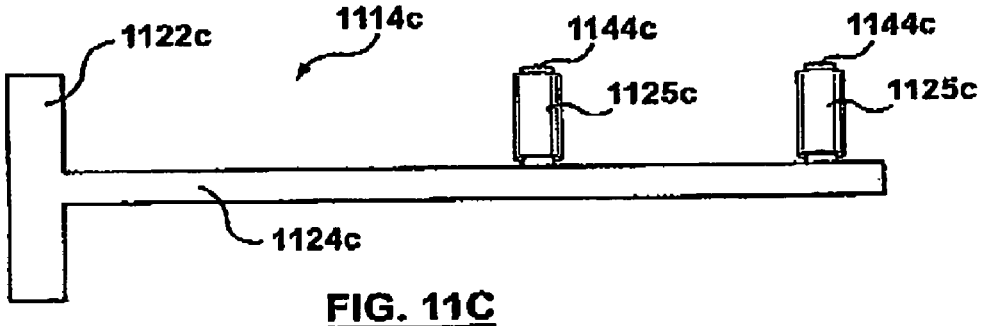

FIG. 11C shows a movable support 1114*c* having a sliding portion 1122*c* connected to a support bar 1124*c*. Support bar 1124*c* has two spaced handles 1144*c* extending there from, with grips 1125*c*, such as rubber or foam grips, disposed on handles 1144*c*.

Figure 11D:
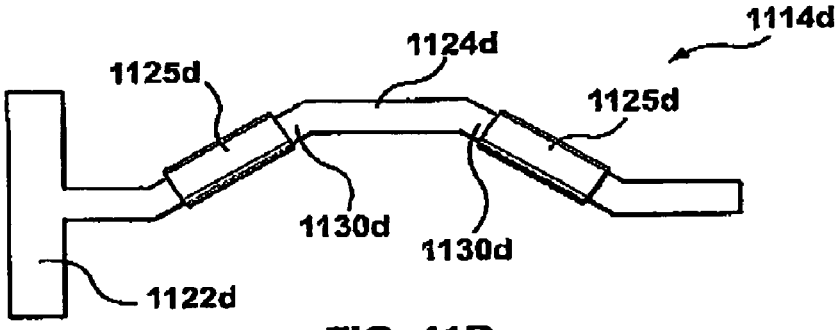

FIG. 11D shows a movable support 1114*d* having a sliding portion 1142*d* connected to a support bar 1124*d*. Support bar 1124*d* is not straight, but rather comprises angled portions having axes that are angularly displaced relative to axes of other portions of support bar 1124*d*. As illustrated in FIG. 11D, support bar 1124*d* may have an inverted U shape or V shape formed therein. Angularly displaced portions 1130*d* may have grips 1125*d* disposed thereon. Additionally, although not shown, each of the movable supports shown in FIGS. 11A to 11D may have actuation means 240, such as an actuation lever located at a convenient location on the support bar for manipulation and activation by a person using the support apparatus to apply brakes or select a position, as described above.

Referring now to FIGS. 12 to 16, a further embodiment of the support apparatus is shown and designated by reference numeral 1210. Support apparatus 1210 may be the same as any of the previously described embodiments of support apparatus, except that it uses a moveable support 1214 having a support arm 1224 of an alternative structure to the previously described support arm embodiments.

Support arm 1224 has a first portion 1260 connected to sliding portion 1222 and a second portion 1266 connected to the first portion 1260 by an intermediate portion 1264. The first portion 1260 extends away from sliding portion 1222 along a first lateral axis and the second portion 1266 extends generally away from sliding portion 1222 along a second lateral axis that is substantially parallel to the first lateral axis. The intermediate portion 1264 connects the first and second portions 1260, 1266 and extends along a third axis that is angularly displaced relative to the first and second lateral axes. In simple terms, the support bar 1224 has a kink in it, because of the angular displacement of the intermediate portion 1264 relative to first and second portions 1260, 1266.

Figure 13:
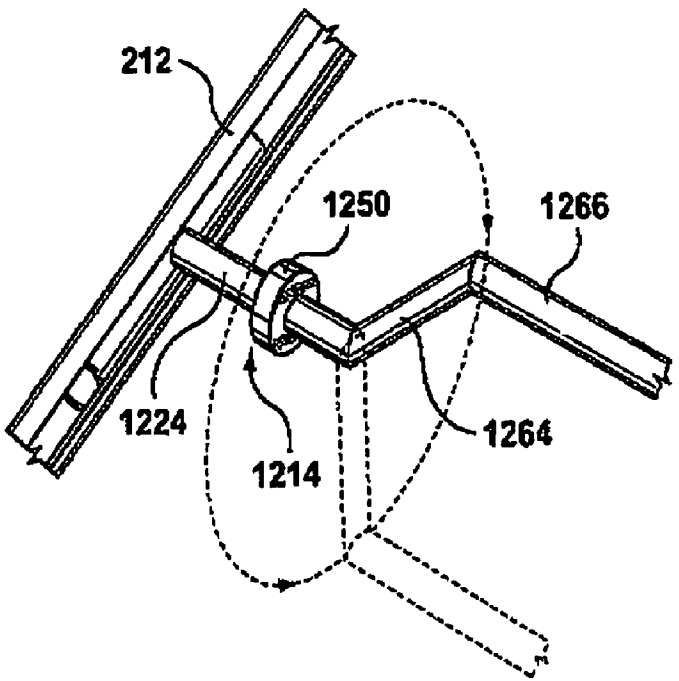
FIG. 13 is a close up perspective view of a movable support used in the assisted walking apparatus of FIG. 12.
Figure 12:
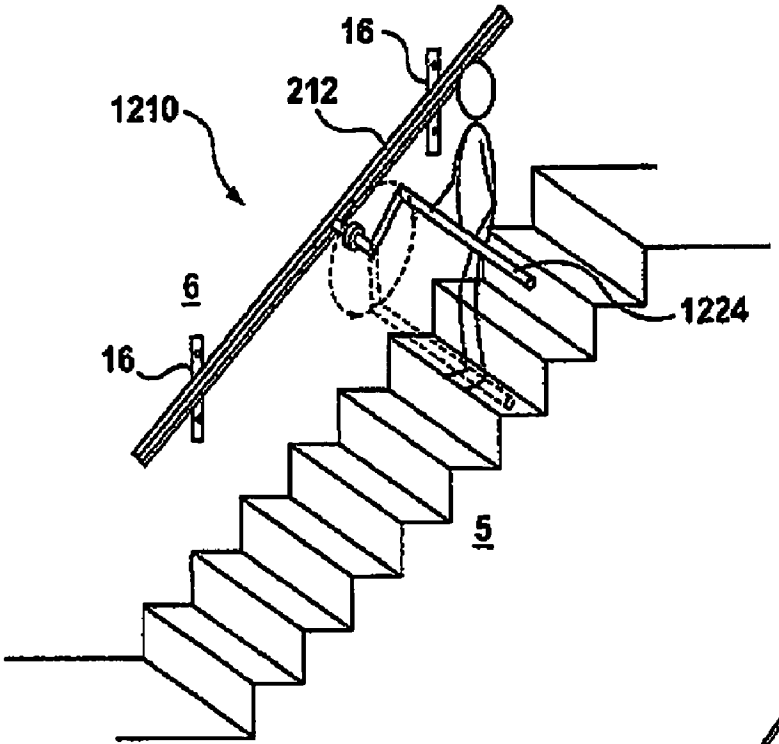
FIG. 12 is a perspective view of an alternative assisted walking apparatus, in use, according to another embodiment of the invention.
Figure 14:
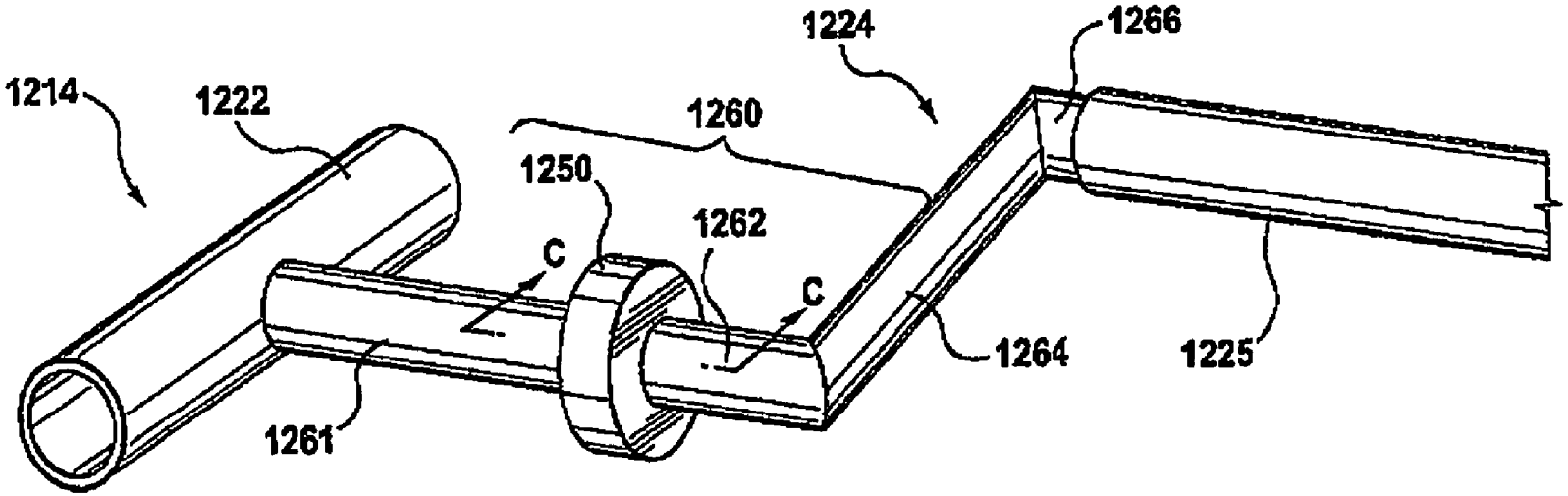
FIG. 14 is a perspective view of a further alternative movable support for use with embodiments of the invention.

Support arm 1224 also comprises an actuator 1250 for allowing first and second sub-portions 1261, 1262 of first portion 1260 to rotate relative to each other. This relative rotation of sub-portions 1261 and 1262 allows the second portion of 1266 of support bar 1224 to be repositioned through rotation up to 360 degrees (or more), advantageously allowing a person using the support apparatus 1210 to effectively raise or lower the position of second portion 1266 to suit the person's requirements while traversing the stairs 5. Second support bar portion 1266 is shown in FIG. 14 as having a grip 1225 extending therealong. As described in relation to other embodiments previously, second portion 1266 may also have handles or actuation means (for example, for position selection or braking) positioned thereon. The re-positioning of the second portion 1266 of support bar 1224 is illustrated in FIGS. 12 and 13.

Figure 16:
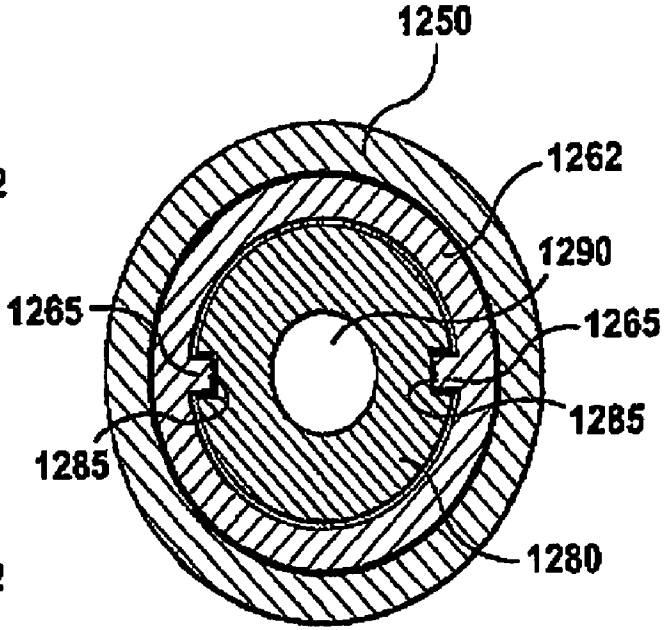
FIG. 16 is a cross-section of the movable support of FIG. 14, taken along the line D-D of FIG. 15.
Figure 15:
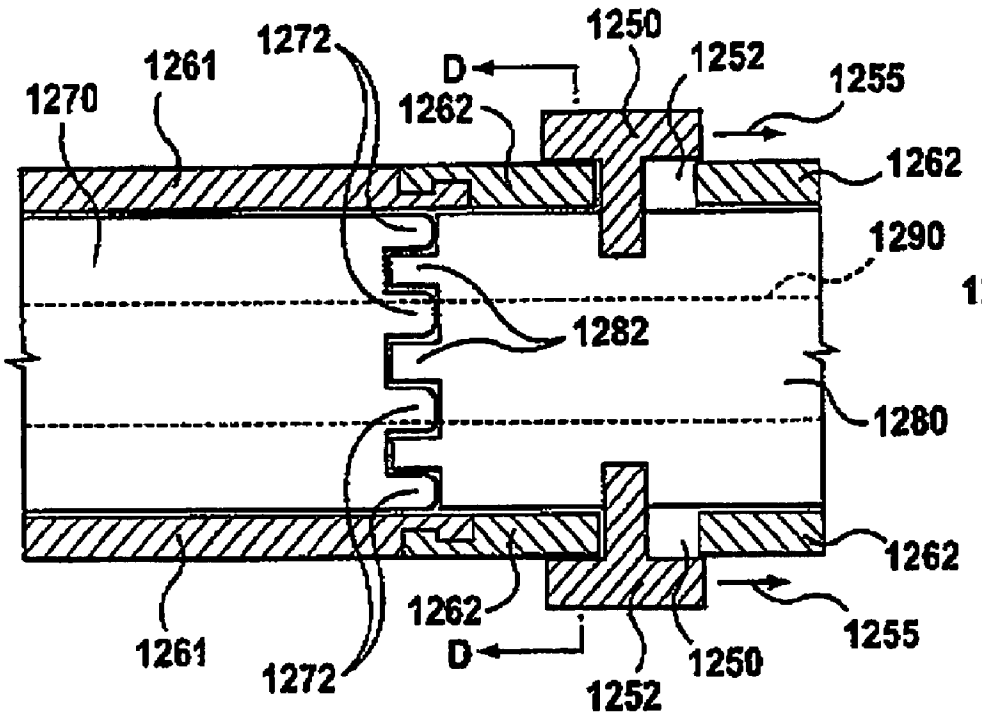
FIG. 15 is a partial cross-section of a proximal portion of the movable support of FIG. 14, taken along the line C-C.

The internal structure of first portion 1260, including actuator 1250, is shown in more detail in FIGS. 15 and 16. As shown in FIG. 15, sub-portion 1261 has a first engaging portion 1270 in the form of a hollow cylindrical member having teeth 1272 disposed circumferentially around one end in an axial direction. First engaging portion 1270 is fixed against movement relative to first sub-portion 1261. First and second sub-portions 1261, 1262 are connected to each other so as to prevent lateral (axial) movement but allow relative rotation. A second engaging portion 1280 is housed generally within second sub-portion 1262 and is fixed against rotation relative to second sub-portion 1262. However, second engaging portion 1280 is laterally (axially) slidable relative to second sub-portion 1262.

As shown in FIG. 15, second engaging portion 1280 has a number of teeth 1282 for interlocking with engaging teeth 1272 of the first engaging portion 1270. In order to rotate first and second sub-portions 1261, 1262 relative to each other, it is necessary to disengage teeth 1272, 1282 from each other by pulling second engaging portion 1280 laterally away from first engaging portion 1270. This lateral movement of second engaging portion 1280 can be achieved by moving actuator 1250 in the direction of arrows 1255, away from first sub-portion 1261. Actuator 1250 is connected to second engaging portion 1280 through slots 1252 in the wall of second sub-portion 1262.

As shown in FIGS. 14 to 16, actuator 1250 has a generally annular shape. Actuator 1250 has at least two inward connector pieces for connecting the outer annular portion of actuator 1250 to the second engaging portion 1280 through slots 1252. When actuator 1250 is moved in the direction of arrows 1255, the first and second engaging portions 1270, 1280 are placed in a disengaged position, in which the first and second sub-portions 1261, 1262 can rotate relative to each other.

Support bar 1224 also comprises at least one biasing element (not shown) for biasing actuator 1250 in the opposite direction to arrows 1255, so that, in the absence of a force pushing actuator 1250 in the direction of arrows 1255, the first and second engaging portions 1270, 1280 remain engaged and first and second sub-portions 1261, 1262 are not permitted to move relative to each other. The at least one biasing element may include a suitable spring, rubber member or other elastically resilient member.

As illustrated in FIG. 15, teeth 1272 of the first engaging portion 1270 are rounded, while teeth 1282 of the second engaging portion 1280 are not rounded. The rounding of teeth 1272 is to allow for increased ease of engagement of teeth 1282 with teeth 1272 upon release of second engaging portion 1280 from an axially displaced position in the direction of arrows 1255.

As shown in FIG. 16, second engaging portion 1280 has a bore 1290 extending therethrough. This bore extends all the way through support arm 1224 in order to allow the passage of cables 248, 348 or other connecting means employed by actuation means disposed on the support arm 1224. Second engaging portion 1280 also has slots 1285 extending in an axial direction, which mate with corresponding protrusions 1265 on second sub-portion 1262 for allowing relative axial movement therebetween but preventing relative rotational movement therebetween.

While one example of actuation means is shown in FIGS. 14 to 16 in the form of actuator 1250, it should be understood that alternative actuation means may be provided for causing second engaging portion 1280 to disengage from first engaging portion 1270. For example, second engaging portion 1280 may be pulled away from first engaging portion 1270 by a cable in response to actuation of a lever attached to the cable, in a manner similar to that of actuation means 240. Alternatively, second engaging portion 1280 may be pulled away by a cable connected to a button-actuated lever located at the end of support arm 1224, for example.

It should be understood that, while sub-portions 1261, 1262 may be fixed against relative rotation by interengaging teeth, such as is shown in FIG. 15, alternative structures may be employed to prevent such relative rotation when actuator 1250 is not actuated.

In further embodiments, the support bar 24, 124, 224, 324, 1124*a-d* and 1224 may include a pivot mechanism (not shown) in the support bar within a few inches of where it attaches to the slider so that, instead of having to provide radial slots 28 at each end of the fixed support, the main length of the support bar that extends away from the slider can simply be pivoted to pend downwardly into a stowed, out-of-the-way position. Such a pivot mechanism which may be formed using a standard pivoting joint to allow pivoting in a single plane of rotation, must not allow the support bar to pivot downwardly while the user is relying on it to support his or her weight. Accordingly, the pivot mechanism requires a locking mechanism to lock the support bar against pivoting at the pivot mechanism and a corresponding manually actuable release mechanism to allow the support bar to be moved from a laterally extended position to a downwardly pending stowed position.

While embodiments described herein are shown and described as employing a downwardly pending stowed position for the support bar, it should be understood that an oppositely disposed upwardly extending stowed position may be employed instead, either using a modified radial slot 28 or a pivot mechanism in the support bar. For such embodiments, it is desirable to have a latch or fixing member, for example, on the support bar or on the fixed support or wall to prevent the support bar from inadvertently dropping downwardly.

In still further embodiments, the slider 22, 122, 222, 322 and 1122*a-d* may have a catch positioned to engage a boss or protrusion, or other form of rigidly fixed engaging structure, positioned at predetermined intervals along the inside of the bore of fixed support 12, 112, 212, 312. This catch serves to act as a safety mechanism to prevent further progress of the slider relative to the fixed support because of abutment of the catch against the protrusion. In order for the moveable support to progress past the protrusion, the catch must be released, for example by actuation of a lever located on the support bar and coupled to the catch.

The protrusions within the bore of the fixed support may be spaced at intervals of about one to two feet, for example. Thus, where a person becomes unbalanced and for some reason is not able to select a locking position to fix the movable support against further movement, and may therefore be at risk of falling, the support bar will not be allowed to progress further than the interval between protrusions engaged by the catch on the slider, preventing the fall from being substantial. Thus, the catch and regularly spaced protrusions provide an added safety feature.

While several embodiments are hereinbefore described, it should be understood that many of the features and/or elements described may be used in substitution or in combination with other described features and/or elements. All such substitutions and combinations fall within the spirit and scope of the present invention. Further, some enhancements and modifications of the described features may be apparent to those skilled in the art, without departing from the spirit and scope of the invention.

The invention claimed is:

1. Apparatus for assisted traversal of an inclined structure, comprising:

a fixed support fixed relative to the inclined structure; and a movable support slidably movable relative to the fixed support along a longitudinal axis of the movable support, the movable support having a locking portion cooperating with the fixed support for releasably fixing the movable support against movement along the longitudinal axis and having a sliding portion and a support portion, the support portion extending away from the sliding portion for supporting a person during traversal of the inclined structure;

wherein the longitudinal axis is substantially parallel to an incline of the inclined structure and wherein the support portion has a first portion extending away from the sliding portion along a first lateral axis and a second portion extending away from the first portion along a second lateral axis offset from the first axis;

wherein the first portion comprises first and second coaxial subportions in rotating connection with each other, the first and second subportions having respective first and second engaging portions, wherein, when the first and second engaging portions are engaged with each other, the first and second subportions are fixed against relative rotation, and when the first and second engaging portions are disengaged from each other, the first and second subportions are rotatable relative to each other.

2. The apparatus of claim 1, further comprising an engaged position, in which the first and second engaging portions are engaged and wherein the first and second engaging portions have interengaging teeth for engaging each other in the engaged position.

3. The apparatus of claim 2, further comprising an actuator for causing the first and second engaging portions to be disengaged and wherein the actuator is connected to the second engaging portion and is operable to cause the second engaging portion to disengage from the first engaging portion.

4. The apparatus of claim 3, wherein the actuator comprises a radially extending portion connected to the second engaging portion so that, when the radially extending portion is pulled in a direction away from the sliding portion, the second engaging portion is pulled in a direction away from the first engaging portion, thereby disengaging the first and second engaging portions.

5. The apparatus of claim 1, wherein said fixed support is fixed to a wall adjacent to said stairs inclined structure.

6. The apparatus of claim 1, wherein said first portion is disposed at one end of the movable support and fixed against movement other than a limited degree of rotation and along said direction.

7. The apparatus of claim 1, wherein, in use of the apparatus, the movable support is securable against movement relative to said fixed support by a locking mechanism.

8. The apparatus of claim 7, wherein said fixed support includes an elongate slot having discrete locking positions at which said movable support is securable against movement relative to said fixed support.

9. The apparatus of claim 8, wherein the elongate slot comprises a plurality of recesses for receiving an engaging part of the movable support, each recess corresponding to a respective discrete locking position.

10. The apparatus of claim 8, wherein said movable elongate slot includes a plurality of notches for receiving at least a part of said movable support therein to secure said movable support against movement relative to said fixed support.

11. The apparatus of claim 1, wherein the movable support comprises at least one grip disposed away from the fixed support.

12. The apparatus of claim 11, wherein the movable support comprises an elongate bar and the at least one grip is disposed on or adjacent the bar.

13. The apparatus of claim 12, wherein, in an extended position, the bar extends substantially laterally of the fixed support and, in a stowed position, at least part of the bar extends downwardly of the fixed support.

14. The apparatus of claim 1, wherein at least a portion of the bar movable support is pivotably movable relative to the fixed support.

15. The apparatus of claim 1, wherein the first and second lateral axes are substantially parallel and wherein the first and second portions are connected by an intermediate portion.

* * * * *